US006368151B1

(12) United States Patent
Chen et al.

(10) Patent No.: US 6,368,151 B1
(45) Date of Patent: Apr. 9, 2002

(54) ELECTRICAL CONNECTOR ASSEMBLY

(75) Inventors: Tong Hsing Chen; Heng Ming Chen, both of Taipei (TW)

(73) Assignee: Cheng Uei Precision Industry Co., Ltd.

( * ) Notice: Subject to any disclaimer, the term of this patent is extended or adjusted under 35 U.S.C. 154(b) by 0 days.

(21) Appl. No.: 09/751,544

(22) Filed: Dec. 29, 2000

(51) Int. Cl.[7] ..... H01R 13/60
(52) U.S. Cl. ..... 439/541.5; 439/620
(58) Field of Search ..... 439/541.5, 701, 439/607–610, 620, 490, 489

(56) References Cited

U.S. PATENT DOCUMENTS 6,113,422 A * 9/2000 Somerville et al. ..... 439/620
6,183,292 B1 * 9/2000 Chen et al. ..... 439/541.5
6,159,039 A * 12/2000 Wu ..... 439/541.5
6,162,089 A * 12/2000 Costello et al. ..... 439/541.5
6,174,198 B1 * 1/2001 Wu et al. ..... 439/541.5

* cited by examiner

*Primary Examiner*—Gary Paumen
*Assistant Examiner*—James R. Harvey
(74) *Attorney, Agent, or Firm*—Wei Te Chung

(57) ABSTRACT

An electrical connector assembly (10) includes an insulative frame (1), first and second electrical connectors (2, 4), an electronic element (3), a dielectric spacer (32) and a metallic shield (5). The frame defines a first receiving cavity (11) and a second receiving cavity (12) separated from the first receiving cavity. The electronic element is electrically connected to first electrical contacts (21) of the first electrical connector, and includes a filtering circuit (33) for getting rid of unwanted signals and a plurality of electrical terminals (31) retained in the spacer. A subassembly of the first electrical connector, the electronic element and the spacer is received in the first receiving cavity of the frame and the second electrical connector is retained in the second receiving cavity of the frame. The shield encloses the frame.

1 Claim, 4 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly integrating electrical connectors of different types and having good signal transmission quality.

2. Description of the Related Art

Electrical connectors such as jack connectors and Universal Serial Bus (USB) connectors are configured mainly according to their different utilizing applications. The USB and jack connectors are usually mounted to mother boards and network cards respectively. Computers are being made smaller and smaller these days to meet increasing demands for portability requirements. Network cards are increasingly being integrated into mother boards, and jack connectors originally mounted on the network cards are now being mounted to the mother boards. However, adding a jack connector enlarges the size of a mother board, which is contrary to the trend toward portability. Thus electrical connectors have been integrated to form multi-port connector assemblies.

However, when electrical connectors of different types are integrated, signal transmission quality is a problem that must always be addressed.

Therefore, an improved electrical connector assembly incorporating electrical connectors of different types and providing good signal transmitting quality is desired to overcome the disadvantages of the prior art.

SUMMARY OF THE INVENTION

A major object of the present invention is to provide an electrical connector assembly comprising electrical connectors of different types.

A further object of the present invention is to provide an electrical connector assembly having good signal transmission quality.

An electrical connector assembly in accordance with the present invention comprises an insulative frame, a first electrical connector, a second electrical connector, an electronic element, a dielectric spacer, and a metallic shield. The insulative frame accommodates the first and second electrical connectors, the electronic element and the spacer therein. The first electrical connector comprises a first insulative housing and a plurality of first electrical contacts mounted to the first insulative housing at one end thereof. Another end of each first electrical contact of the first electrical connector is electrically connected to the electronic element. The electronic element comprises a filtering circuit and a plurality of electrical terminals depending therefrom. The dielectric spacer retains electrical terminals of the electronic component. The second electrical connector comprises at least one second insulative housing, a plurality of second electrical contacts mounted in the housing and a shell enclosing the housing and the second electrical contacts. The electrical terminals and the second electrical contacts are mounted to a mother board.

Other objects, advantages and novel features of the invention will become more apparent from the following detailed descriptions of the preferred embodiments when taken in conjunction with the accompanying drawings.

DETAILED DESCRIPTION OF THE INVENTION

Figure 1:
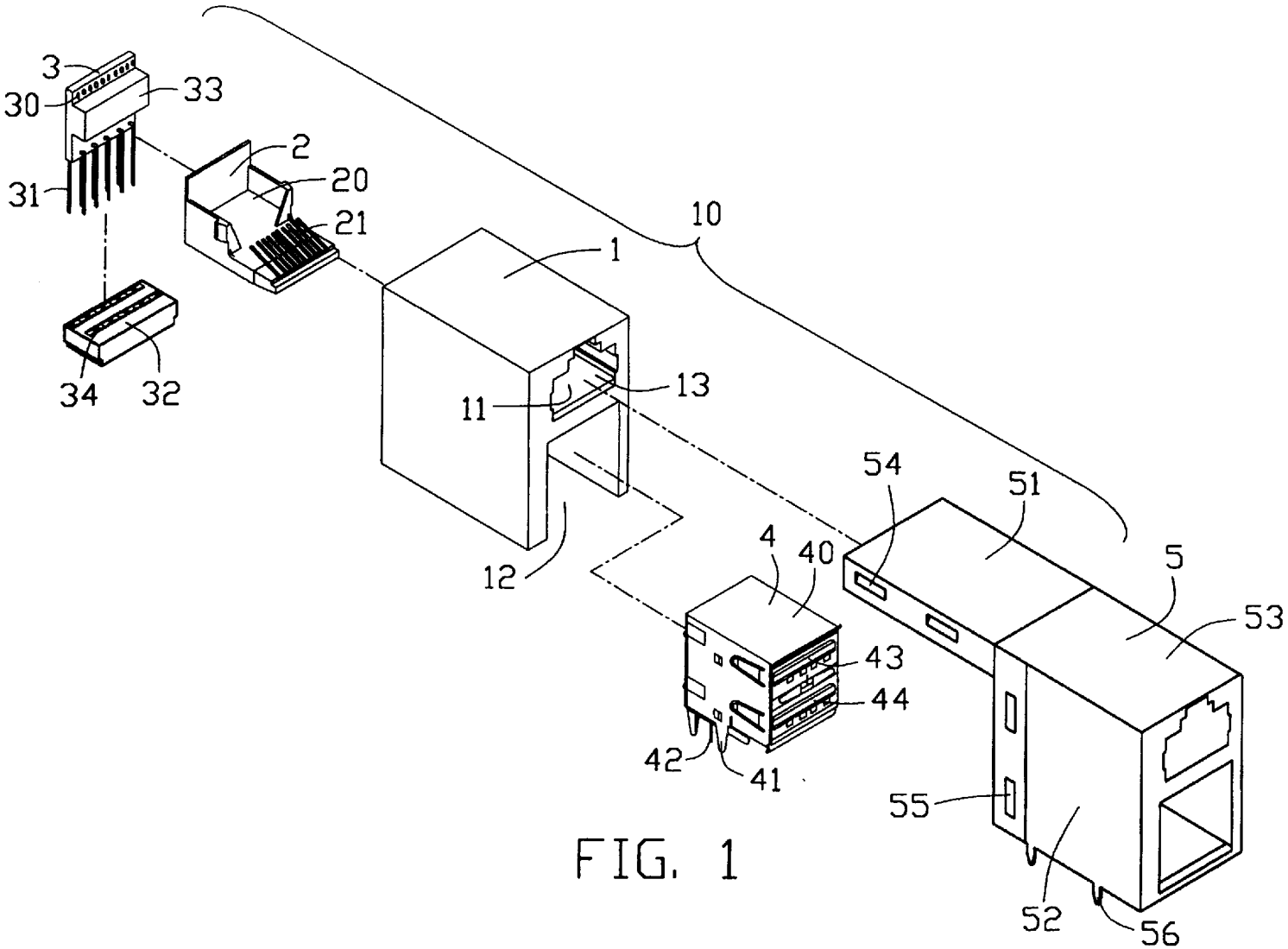
FIG. 1 is an exploded view of an electrical connector assembly in accordance with a preferred embodiment of the present invention.

Referring to FIG. 1, an electrical connector assembly 10 in accordance with a preferred embodiment of the present invention comprises an insulative frame 1, a first electrical connector 2, an electronic element 3, a dielectric spacer 32, a second electrical connector 4 and a conductive metallic shield 5.

Figure 3:
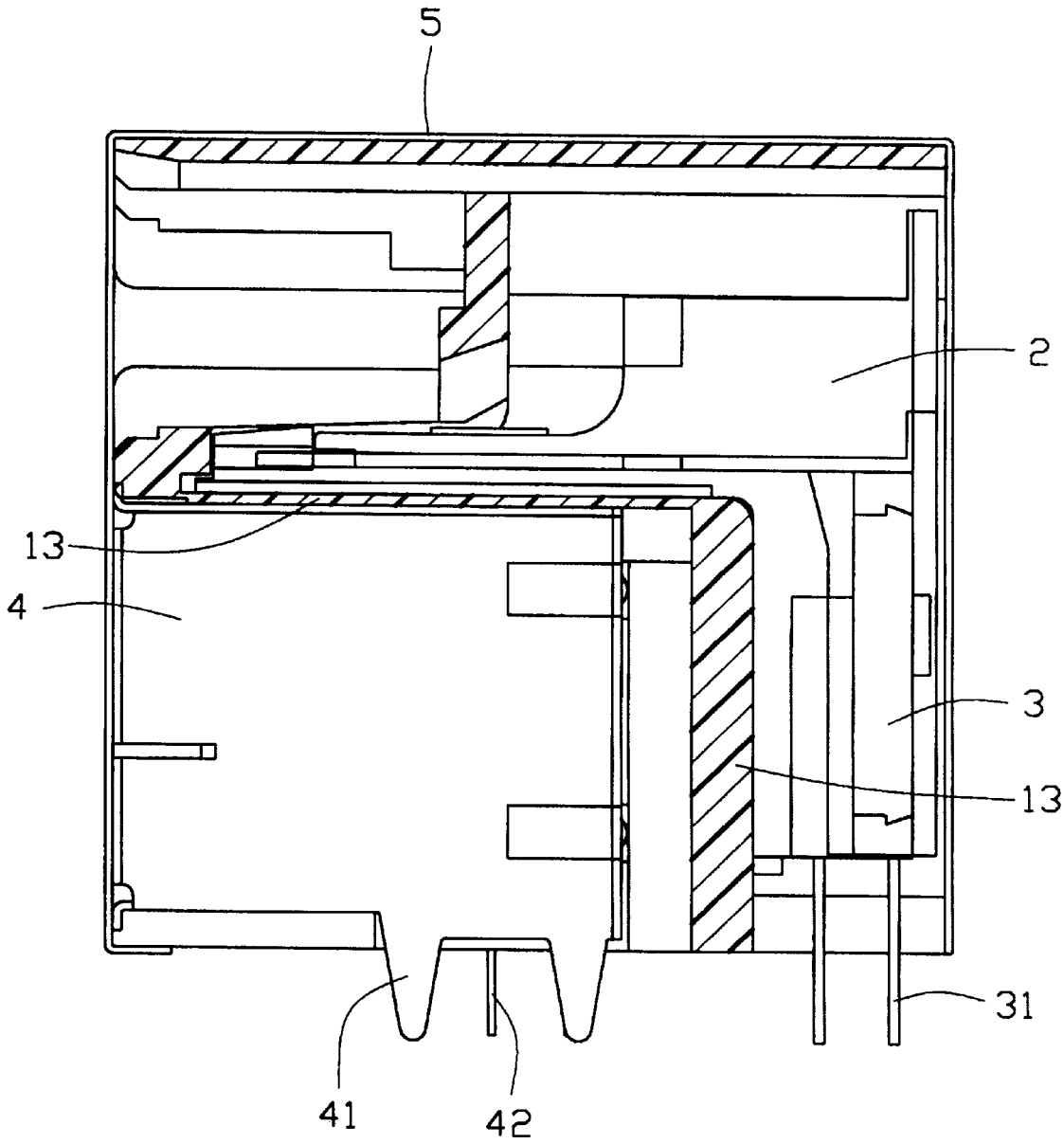
FIG. 3 is a cross-sectional view taken along the line 3—3 of FIG. 2.

The frame 1 defines a first receiving cavity 11 and a second receiving cavity 12 separated from the first receiving cavity 11 by a spacing plate 13 (best shown in FIG. 3). The first receiving cavity 11 is formed as a modular jack receptacle at upper and front portions thereof, and further includes a retention portion (not shown) therein. The first receiving cavity 11 is for receiving a modular plug connector, which in the preferred embodiment is an RJ-45 modular plug connector (not shown). The second receiving cavity 12 is defined in front and bottom portions of the frame 1.

The first electrical connector 2 comprises a first insulative housing 20 and a plurality of first electrical contacts 21 mounted in the first housing 20. Each first electrical contact 21 each has a contacting portion bent upwardly and rearwardly from a front end of the housing 20 and a connecting portion (not shown) extending directly rearwardly from a rear end of the first housing 20.

The electronic element 3 comprises a filtering circuit 33 and a plurality of electrical terminals 31 depending downwardly from the electronic element 3. A row of soldering points 30 is defined on the electronic element 3 above the filtering circuit 33.

The spacer 32 is in shape of an elongated block and defines a plurality of passageways 34 arranged in two rows and extending vertically through the spacer 32.

The second electrical connector 4 is a dual-port USB connector which comprises a metallic shell 40, two second insulative housings 43, 44, and a plurality of second electrical contacts 42. The shell 40 forms second grounding tabs 41 depending therefrom.

The shield 5 is open at front and bottom sides thereof. The shield 5 has a top piece 53, side pieces 52, and a rear piece 51 extending rearwardly from the top piece 53. The rear piece 51 is downwardly pivotable about its junction with the top piece 53. The rear piece 51 and the side pieces 52 respectively form corresponding engaging mechanisms 54, 55 thereon. The shield 5 forms first grounding tabs 56 depending therefrom.

Figure 2:
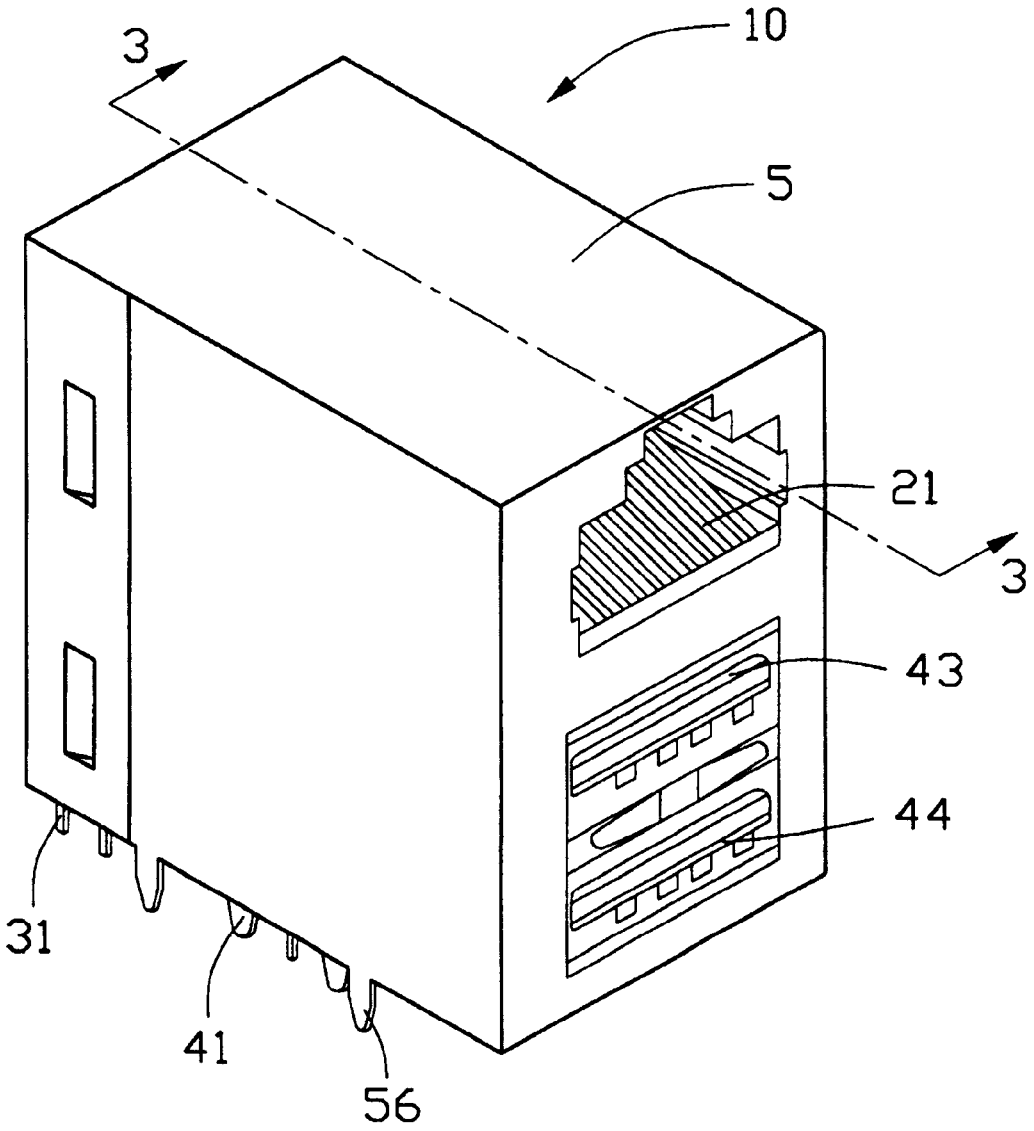
FIG. 2 is an assembled perspective view of the electrical connector assembly of FIG. 1.

Referring also to FIGS. 2 and 3, in assembly, the connecting portions of the first electrical contacts 21 of the first electrical connector 2 are soldered to the soldering points 30 of the electronic element 3. The terminals 31 of the electronic element 3 extend through and are retained by the passageways 34 of the spacer 32. The subassembly of the first electrical connector 2, the electronic element 3 and the spacer 32 is then inserted in a rear-to-front direction into the first receiving cavity 11 of the frame 1. The said subassembly is retained at the retention portion of the first receiving cavity 11 by means which are conventional in the pertinent art. The second electrical connector 4 is inserted into the second receiving cavity 12 of the frame 1 and is interferentially retained therein. The spacing plate 13 supports the first electrical connector 2 thereon, and dielectrically separates the second electrical connector 4 from the said subassembly of the first electrical connector 2, the electronic element 3 and the spacer 32. The frame 1 with the first and second electrical connectors 2, 4, the electronic element 3 and the spacer 32 therein is inserted into the shield 5 from a rear side thereof. The rear piece 51 is then rotated downwardly to be coupled to the side pieces 52 by means of engagement between the respective engaging mechanisms 54 and 55 thereof, to provide reliable shielding for the electrical connector assembly 10. Tail portions of the second electrical contacts 42, the electrical terminals 31, the second grounding tabs 41 and the first grounding tabs 56 extend beyond a bottom of the frame 1, to be mounted to a mother board(not shown).

Figure 4:
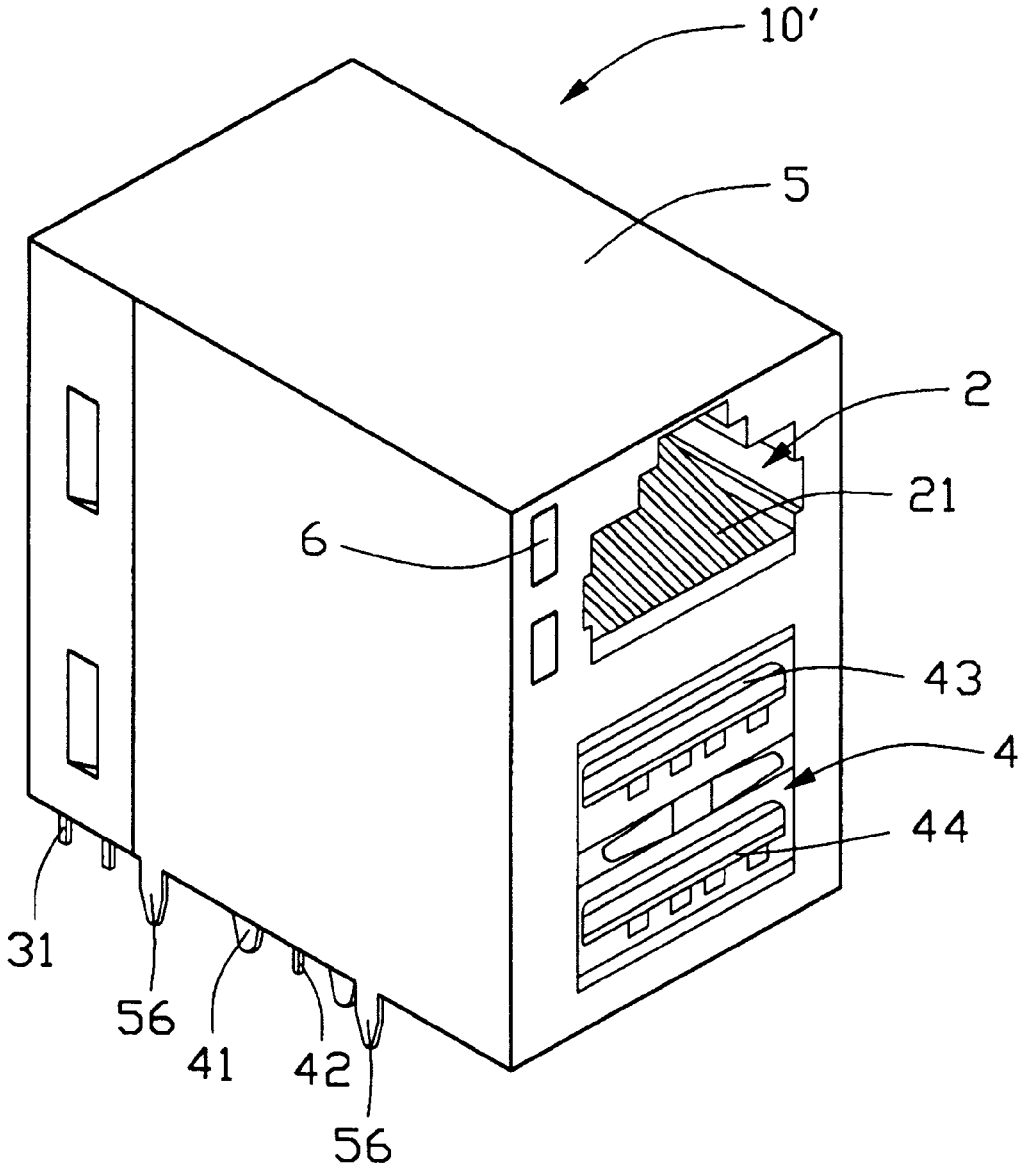
FIG. 4 is an assembled perspective view of an electrical connector assembly in accordance with an alternative embodiment of the present invention.

Referring to FIG. 4, an electrical connector assembly 10' in accordance with an alternative embodiment of the present invention is similar to the electrical connector assembly 10 of the preferred embodiment shown in FIGS. 1–3. However, in the alternative embodiment, two light emitting diodes (LEDs) 6 are mounted to the frame 1 and exposed by the shield 5, to indicate to a user a connecting status as between the first electrical connector 2 and a mating complementary modular plug connector (not shown). The LEDs 6 are arranged one above the other. FIG. 4 shows reference numerals for the alternative embodiment similar to those for the preferred embodiment, and further detailed description of the alternative embodiment is omitted herein.

In use, the filtering circuit 33 gets rid of unwanted signals received from the first electrical contacts 21 before proceeding to transmit the remaining desired signals to the mother board via the terminals 31. Thus good signal transmission quality is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative frame defining a first receiving cavity and a second receiving cavity therein;

a first electrical connector received in the first receiving cavity, the first electrical connector comprising a first insulative housing and a plurality of first electrical contacts mounted in the first housing;

an electronic element electrically connected to the first electrical contacts of the first electrical connector and received in the first receiving cavity, the electronic element comprising a filtering circuit and a plurality of electrical terminals;

a dielectric spacer retaining the electrical terminals of the electronic element and accommodated in the first receiving cavity; and a second electrical connector retained in the second receiving cavity of the frame:

further comprising a metallic shield enclosing the frame, the first and second electrical connectors, the electronic element and the spacer;

wherein the first receiving cavity of the frame is separated from the second receiving cavity by a spacing plate;

wherein the second electrical connector is a USB connector and comprises at least one second insulative housing, a plurality of second electrical contacts mounted in the second housing and a shell enclosing the second housing and the second electrical contacts;

wherein the first receiving cavity is formed as a modular jack receptacle whereby the first electrical connector is connectable with a modular jack plug connector;

wherein the first connector is for connecting with an RJ-45 modular plug connector;

wherein each first electrical contact has a contacting portion bent upwardly and rearwardly from a front end of the first housing;

further comprising a plurality of LEDs mounted in the frame and exposed by the metallic shield, for indicating connecting status as between the first electrical connector and a mating complementary connector.

* * * * *